US005848913A

United States Patent [19]

Ashcraft

[11] Patent Number: 5,848,913

[45] Date of Patent: Dec. 15, 1998

[54] SET SCREW CONNECTOR AND METHOD

[75] Inventor: Thomas K. Ashcraft, Fort Mitchell, Ky.

[73] Assignee: Erico International Corporation, Solon, Ohio

[21] Appl. No.: 990,405

[22] Filed: Dec. 15, 1997

Related U.S. Application Data

[62] Division of Ser. No. 601,760, Feb. 15, 1996, Pat. No. 5,727,314.

[51] Int. Cl.[6] ..... H01R 13/52

[52] U.S. Cl. ..... 439/521; 439/813; 439/798

[58] Field of Search ..... 439/521, 813, 439/810, 814, 797, 798, 921

[56] References Cited

U.S. PATENT DOCUMENTS 3,983,314 9/1976 Fihaber ..... 439/521

4,643,924 2/1987 Uken et al. ..... 439/521

*Primary Examiner*—Steven L. Stephan
*Assistant Examiner*—T C Patel
*Attorney, Agent, or Firm*—Renner, Otto, Boisselle, Sklar

[57] ABSTRACT

An electrical set screw connector has an insulating cover over a metal body which includes conductor receiving passages or ports and intersecting set screws adapted to clamp down on conductor ends in the conductor receiving passages or ports. The connector insulating cover includes a vestibule or tubular chamber for each set screw. The outer end of the vestibule is restricted to capture the screw and each vestibule is internally threaded. The outer end of each vestibule includes a drive hole for the set screw. The connector insulating cover is made by dipping using the backed out set screws as core pins for each set screw vestibule with removable shanks in the set screw recesses forming the drive holes.

8 Claims, 2 Drawing Sheets

SET SCREW CONNECTOR AND METHOD

This is a division of application Ser. No. 08/601,760, filed Feb. 15, 1996, now U.S. Pat. No. 5,727,314.

DISCLOSURE

This invention relates generally as indicated to set screw connector and method, and more particularly to an electrical set screw connector, and to a process for encapsulating the connector with an insulating coating.

BACKGROUND OF THE INVENTION

Set screw electrical connectors are widely used in electrical power transmission. Basically, such connectors are metal bodies with passages or ports for conductors with sizeable set screws extending normal to such passages. A conductor is inserted in an open passage and the set screw is tightened on the conductor to make the connection. Such connectors are commonly used with secondary pad mount transformers or utility pedestals. Examples are the underground extruded and cast connectors and splices, the overhead connectors and the metering and grounding lugs sold by ERICO, Inc. of Solon, Ohio, under the registered trademark ESP®.

Depending on customer requirements, an insulating cover may be provided on such connectors to protect against incidental contact between an energized connector and ground, another connector, or another conductor. Some connectors used underground are submersible and have a watertight EDPM rubber cover. An example is the UPP connector sold by ERICO, which is also shown in the copending application of David R. Fillinger et al., Ser. No. 08/376,868 filed Jan. 23, 1995 and entitled Submersible Electrical Set Screw Connector.

Other types of insulation covers for such connectors include insulating boots made of PVC fitted over the connector once the conductors have been joined to the connector. Also, such connectors may have slip-on covers having star shaped or slit penetration slots at the ports to permit the conductors to pass through, and holes or penetration slots to permit access to the set screws. Examples are type USPO-I, UPM-I slip-on covers, and type B, BEA and UPT-PVC boots and shields, all sold by ERICO of Solon, Ohio.

Another type of connector employs a non-watertight insulating cover such as the UPC type of connector sold by ERICO. This type of connector is insulated by a dip coat formed envelope of plastisol (polyvinyl chloride). The insulating cover completely encases the connector within a clear or opaque PVC jacket except for the entry ports for the conductors and set screws which are provided with tubular extensions or vestibules. On some connectors where the slip-on insulation cover goes over the top of the set screw, access for the tool for turning the set screw is provided by a self-closing cut in the insulation housing.

The process for making this type of UPC connector requires removable core pins for making the tubular extensions or vestibules, and if a screw opening access is employed, the core pin has to be removed through the opening. Accordingly, such openings have to be larger than what might be required for a set screw driver such as an alien wrench. Such openings are not easy to make and the making of the opening and removal of the core pins is labor intensive, and the cover may be damaged or torn in the process. Moreover, if the core pin can come out through the opening, so can the set screw. Even if the set screw is backed out just far enough to become disengaged from its threaded socket, rethreading it into its socket may be a problem, particularly with limited access through an opening. Lost, dropped or difficult to engage set screws are always a problem.

The process of making the connector in addition to being labor intensive also has high tooling costs. The connectors are made in a wide variety of sizes, left or right hand types, and set screw types. Each requires its own set of tooling or core pins to form the screw port vestibules. Some connectors have as many as a dozen or more set screws, not necessarily all the same size. Since the process is generally continuous, involving heating and dipping followed by a baking or heat treatment, the investment in tooling to achieve substantial volume to form the cover is substantial. Moreover, such tooling is of the type that keeping it cleaned, sorted, coated, or stored in inventory is a logistical nightmare. They cannot simply collectively be thrown in a bin. This is a very labor intensive process.

It would, accordingly, be desirable to provide a process of making such insulated set screw connectors where the tooling for the set screw ports could be eliminated. It would also be desirable to eliminate the manual operations required for the insertion and removal of such tooling. It would further be desirable to provide a set screw connector where the set screw is captured, preset in the out position clear of the conductor, and if somehow becomes disengaged, can easily be rethreaded in the socket, all while protecting the connector and set screw from incidental contact and a lost screw.

SUMMARY OF THE INVENTION

A set screw connector includes a metal body having side-by-side conductor ports and respective transverse threaded intersecting set screw passages, each receiving a set screw to clamp a conductor to the body. Additionally, ports or passages may be provided on the ends for set screw connections to street lights or to a transformer, for example. The connector can be provided with an insulating coating which includes set screw vestibules, the interior of each being in the substantially precise form of the set screws, and each including a dome over the top of each set screw having a top opening for the insertion of a set screw turning tool such as an allen wrench. The connector may have similar or open vestibules for the conductor ports, or the face of the body at the conductor openings may simply have an oval or square shaped lip, without protruding ports.

Recess hex head alien type set screws are preferred and the size of the hex recess may be the same regardless of the size or type of the set screw. In other words, one allen wrench size may turn all. In the process, the screws are assembled with the body, but are backed out as far as they will go to clear the conductor opening without becoming disengaged from their threaded sockets. It is desirable that the screws for side-by-side same size conductor ports be backed out uniformly and for this purpose, a stop gauge may be used. It is, however, important that the interior of the conductor passage or port be clear of the set screw to receive the largest size conductor acceptable by the connector. If core pins or plugs are used in the conductor passages to form conductor port vestibules, they will be of a size representing the largest size conductor receivable. In this case, the set screws may be finger tightened down on the core pins or plugs both for correct uniformity of extension and to keep both the plug and screw from further movement.

At this point, pieces or shanks of hex stock may be inserted in each hex recess of each set screw. Such hex shanks are the same size as the alien wrench required to turn the screws. Before dipping, mold release is sprayed on the exposed screw thread and the top of the screw including the hex stock. The connector is then heated, dipped in the liquid plastisol, followed by heating, which produces a clear somewhat flexible coating of approximately 100 mil thickness.

The removal of the hex shanks produces a hex hole aligned with the hex recess of each screw. Removal of the cores, plugs or shields at the conductor ports, or transformer stud ports followed by minor trimming, completes the process. Each domed set screw vestibule is now internally threaded and a thread extension of the metal body. Each set screw is captured, each initially at a uniform out position, and each easily operable through the hex hole in the top of the dome. The insulating cover is sufficiently flexible that it provides little resistance to the turning of the allen wrench. It does, however, help keep the alien wrench in place once inserted in the recess. In other words, the installer may let go of the alien wrench once in the recess without it dropping, yet it is readily removed by pulling axially. A more compact and easier to use and install set screw connector is thus provided.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
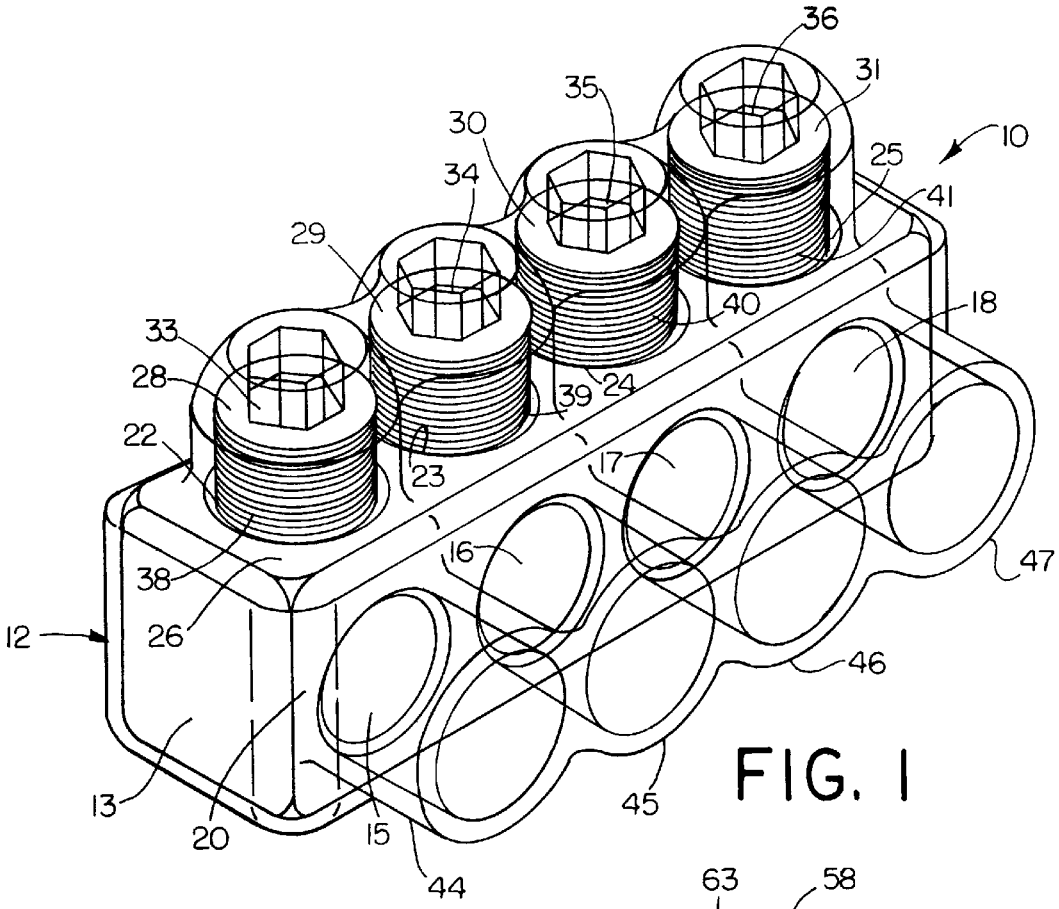
FIG. 1 is a perspective view of a connector in accordance with the present invention.
Figure 2:
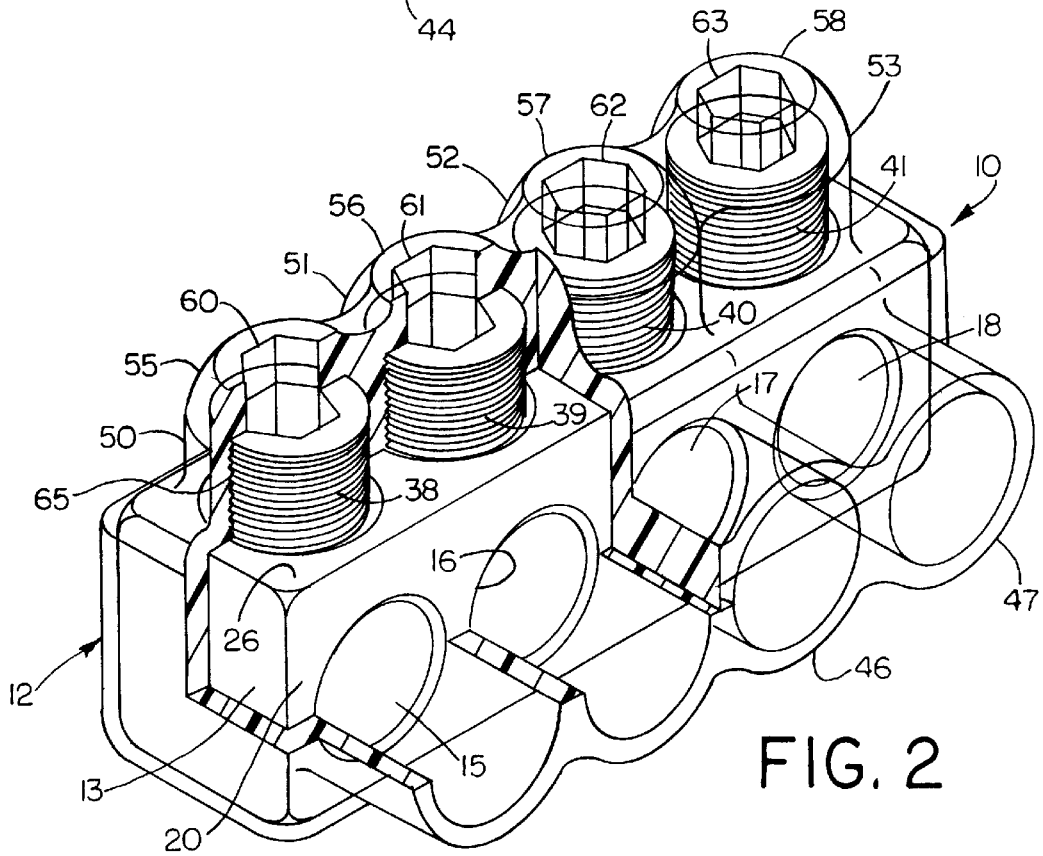
FIG. 2 is a view like FIG. 1 showing the insulating cover partially broken away.

Referring initially to FIGS. 1 and 2, there is illustrated a set screw pedestal connector shown generally at 10 in accordance with the present invention. The set screw connector 10 is enclosed, although not sealed, by a clear plastic insulating cover shown generally at 12 which surrounds the conductive metal body 13 of the connector. The insulating cover is clear plastic material such as polyvinyl chloride, and accordingly, the connector is visible through the cover. The connector illustrated in FIGS. 1 and 2 is only exemplary of many types of set screw connectors which may be formed in accordance with the present invention.

The set screw connector includes an extruded body 13 having four conductor receiving passages or ports 15, 16, 17 and 18 in the front face 20. The passages for receiving the conductors may extend completely through the body from the face 20 to the opposite face. Intersecting the respective passages are internally threaded set screw holes shown at 22, 23, 24 and 25, in the top face 26 of the body. Such holes are axially aligned with the axes of the conductor passages and receive set screws shown at 28, 29, 30 and 31, respectively. At the top, each set screw includes a recessed hexagonal drive head as seen at 33, 34, 35 and 36, respectively. The set screws are normally driven for rotation by an allen wrench which fits snugly in the recessed hexagonal head. The set screws may be made of aluminum which is the same or similar conductive material from which the body is made. For example, the body may be made from a grade 6061 T6 aluminum extrusion. Although only four ports and set screws are illustrated in the embodiment of FIGS. 1 and 2, it will be appreciated that fewer or more may be employed. Typically, the number of ports and set screws may range from two to eight or more.

In FIGS. 1 and 2, set screws 28–31 have been backed out to clear the conductor receiving passages 15–18. This exposes the majority of the threads of the set screw as seen at 38, 39, 40 and 41. This positions the set screws in their "out" or extended position and it is in such position that the insulating coating or cover 12 is formed as hereinafter described.

The cover 12, while not providing a watertight enclosure for the connector, nonetheless provides a soft and pliable cover in an approximate thickness of 100 mils which is designed to prevent incidental contact with the connector. The cover surrounds the substantially square in transverse section metal body 13 and includes tubular extensions or vestibules projecting from the front as seen at 44, 45, 46 and 47 which are open at the front and axially aligned with the conductor receiving passages or ports 15–18.

The set screws are also provided with vestibules or tubular extensions as indicated at 50, 51, 52 and 53, respectively. The set screw vestibules include a domed or somewhat conical top seen at 55, 56, 57 and 58, respectively, each of which includes a hexagonal hole seen at 60, 61, 62 and 63, respectively, each hole being aligned with the hexagonal recess of the set screw. The domed tops of the set screw vestibules capture the respective set screws so they cannot be removed from the connector and each vestibule is internally threaded as indicated at 65 with the internal threads of each vestibule matching the external threads of the set screw. As seen in FIGS. 1 and 2, each of the set screws is backed out to the same extent and each set screw point will clear the largest conductor to be used in the connector. Because of the relatively soft and pliable nature of the insulating cover 12, an allen wrench can readily be inserted in the holes 60–63 to rotate the set screws to clamp upon a conductor inserted in the respective conductor passage. However, a set screw cannot come out of the insulating cover and even if it becomes disengaged with the threads of the body, the threads of the respective vestibules, being the same as those of the screw, the screw may readily be reinserted.

Figure 4:
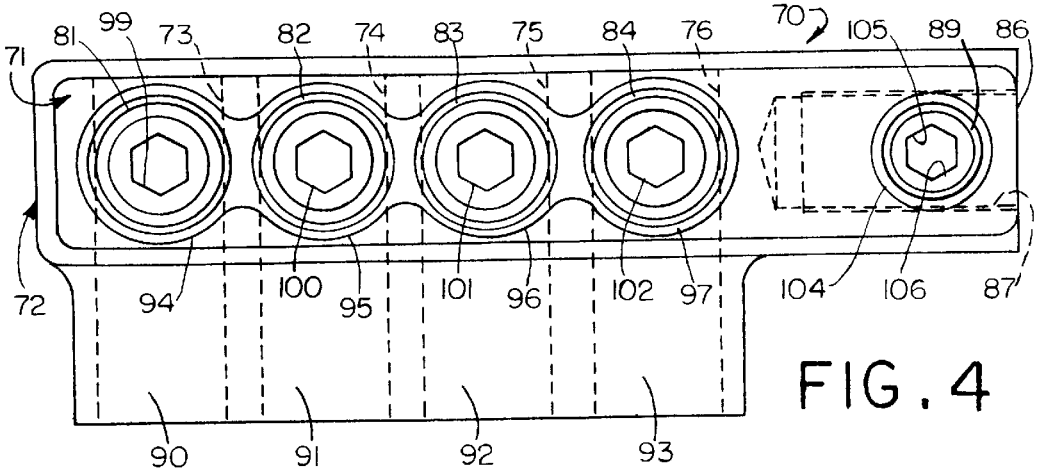
FIG. 4 is a top plan view of the connector shown in FIG. 3 after dipping, removal of the plugs, shanks, and trimming.
Figure 3:
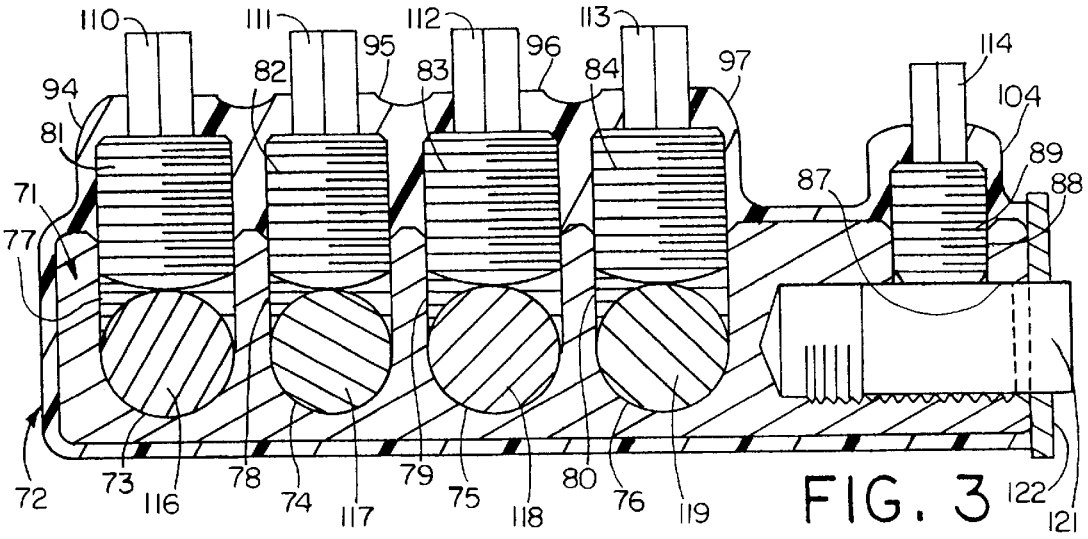
FIG. 3 is a vertical section of another form of connector with conductor port and transformer stud port core pins or plugs in place, the hex shanks in place in the set screws backed out, yet tightened on the plugs following dipping.

Referring now to FIGS. 3 and 4, there is illustrated another or stud type of connector indicated generally at 70 which is designed to be mounted on a transformer stud. The connector includes a metal body 71 and an insulating cover 72. The body includes conductor receiving passages 73, 74, 75 and 76 and threaded holes 77, 78, 79 and 80 intersecting such passages, such holes receiving set screws 81, 82, 83 and 84.

While the conductor passages go through the body 70 from front to rear and the threaded set screw holes intersect such passages extending from the top, the connector of FIGS. 3 and 4 also includes in its end face 86 a blind hole 87. Intersecting the blind hole 87 is a somewhat smaller set screw threaded hole 88 accommodating set screw 89 which when tightened clamps down on the transformer stud securing the connector to the transformer. Details of the preferred configuration of the hole 87 and the clamping of a connector to such transformer stud may be seen in the copending application of David R. Fillinger et al., Ser. No. 08/502,830 filed Jul. 14, 1995 entitled Transformer Electrical Connector, now U.S. Pat. No. 5,690,516. It is noted that the end face 86 of the connector is bare and the insulating cover 72 does not extend over such end face. Different users of such connectors may specify certain faces of the connector not to include an insulating cover. Some users may specify that other faces such as the front be left bare.

As seen in FIG. 4, the cover includes the four vestibules 90, 91, 92 and 93 for the conductor passages and also the vestibules 94, 95, 96 and 97 for the set screws, each including the domed top capturing the set screw and the hexagonal hole for the set screw driver seen at 99, 100, 101 and 102, respectively. The connector also includes a vestibule or tubular extension for the smaller set screw seen at 104 also having hexagonal hole 105 in the top. It is noted that even though the set screw 88 is a smaller set screw and of a different type, flat point versus oval point, it nonetheless has the same size hexagonal recess 106.

As seen more clearly in FIG. 3, the hexagonal holes in the cover for each set screw, regardless of size, is made by a shank of hexagonal stock which is inserted in the hexagonal recess prior to dip coating. In FIG. 3, such hexagonal shanks are seen at 110, 111, 112 and 113, for the larger clamping screws, and at 114 for the smaller set screw.

The vestibules 90–93 are formed by core pins or plugs seen at 116, 117, 118 and 119. The core pins are cylindrical pins which represent the largest size conductor which will be accommodated in the conductor passage. The pins or plugs preferably snugly fit in such passages. A similar core pin or plug is employed at 121 to plug the blind transformer stud hole and such pin may include a removable shield 122 which may, for example, be formed of aluminum tape, which closes the end face 86 of the connector body. Also as seen in FIG. 3, each of the set screws has been backed out or extended to clear the respective passages and has then been finger tightened against the core pins or plugs. The tightening of the set screws keeps both the set screws and the core pins in place for the subsequent dipping operation.

With the shanks, core pins or plugs, and shield in place, mold release is sprayed on the extended set screws and particularly on the exposed threads thereof. The parts are then placed on a rack to move through an oven to elevate the temperature of the parts. When the desired part temperature is reached, the parts are then dipped into the plastisol bath and after dipping are then heated again until the polyvinyl chloride coating cures to a firm yet pliable insulating coating. The combination of the temperature of the parts and the duration of time that the parts are suspended in the bath, determines the thickness of the coating during each dip sequence. After the plastisol cures, the core pins, shank and shields may be removed and the part, if necessary, may be trimmed. Any excess material stripped from the part, plugs, shields or shanks, is recycled. The removal of the shanks seen in FIG. 3 creates the hexagonal openings seen in FIG. 4 and 5, for example, and such openings are the precise dimension of the hexagonal wrench stock. Even though the set screws may vary in size, the recesses may be the same as is the shank as well as the tool used for turning such set screws, for each size or type connector.

Figure 5:
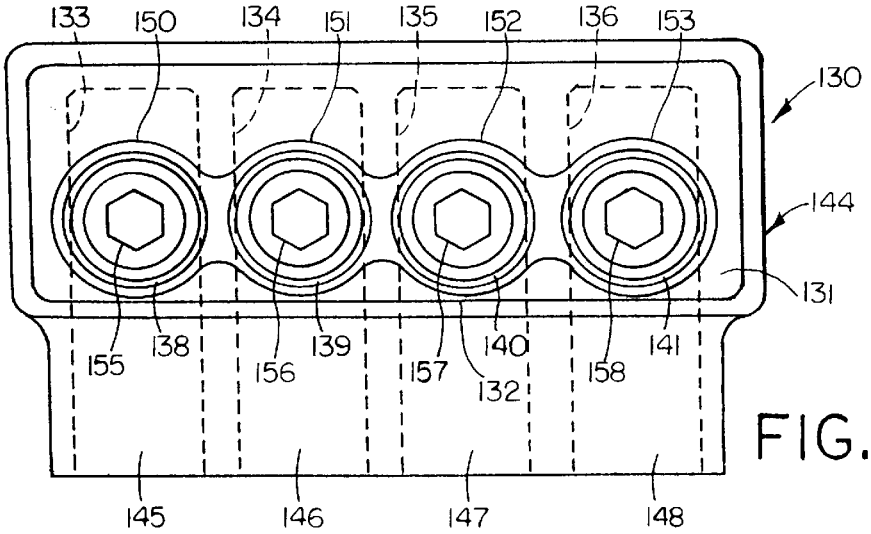
FIG. 5 is a top plan view of another form of connector insulated in accordance with the present invention.

In FIG. 5, there is illustrated another form of connector which is similar to that seen in FIG. 2. The connector shown generally at 130 includes a slightly wider metal body 131 which has in the front (lower) face at 132 blind conductor receiving holes shown at 133, 134, 135 and 136. Such holes do not go completely through the body. Arranged toward the front of the body are the set screw threaded holes 138, 139, 140 and 141. The insulating cover shown generally at 144 includes the conductor hole vestibules seen at 145, 146, 147 and 148 which are formed by core pins or plugs inserted into the conductor receiving passages. The insulating cover also includes the vestibules for the respective set screws seen at 150, 151, 152 and 153. Each has the domed top with the hexagonal hole indicated at 155, 156, 157 and 158, respectively, formed by the shanks as seen in FIG. 3. It is noted that the set screws are placed closer to the front of the body so that as the set screws are tightened, they will not tend to force or extrude the conductor out of the conductor receiving passages.

The connector of FIG. 5 is otherwise the same as that shown in FIGS. 1 and 2. The part is also made by the process described above and summarized below.

In summary, the following are the preferred steps to encapsulate a pedestal connector or stud connector:

1. Back set screws out until they clear top of conductor path openings;
2. Insert conductor port plugs or core part of tooling fully covering the ports;
3. Tighten screws down on to conductor port plugs or cores to hold the tooling in place during the dipping process;
4. Insert the assembly into an oven and heat to a proper temperature;
5. Remove the assembly from the oven and install hex shanks which may be part of a hanger arrangement to hold connector in place while being dipped;
6. Spray silicon release on the screws and hex shanks to keep the PVC from adhering to the threads of the screws and hex shanks of tooling;
7. Place into a vat of clear or opaque colored PVC in a timed sequence to give proper thickness to the coating. The combination of time in the vat and temperature of connector determines the thickness of the coating in a one-dip operation;
8. After a timed sequence, the connector is placed back into a heated oven at a proper temperature to cure the PVC material. PVC is normally a liquid at room temperature and is caused to set up or "cure" with a proper curing temperature;
9. After curing the PVC, the connector is removed from the hanger arrangement and air cooled;
10. The connectors then go to a trimming section. A short length of the hex stems on top of screws at the domed set screw vestibule may be left in place and removed upon use. The connectors then go to inspection prior to packing and shipping.

For stud connectors such as seen in FIGS. 3 and 4, the following are in addition to the above steps:

(a) Back locking set screw out of stud hold until threads clear top of stud hole;

(b) Place a shield such as aluminized tape over stud hole at the end of connector to prepare for the dipping process;

(c) After dipping process is complete and connector is sufficiently cooled, trim excess PVC from hex shank on top of locking set screw at the domed set screw vestibule and trim off PVC from the end at the stud hole of connector leaving entire face as bare metal with exception of the shield. In other words, trim away all PVC so as to provide a metal only face at the stud hole end.

It should be noted that a connector made by the process of the present invention is encapsulated to capture the set screws within the insulating cover and the set screws cannot be lost or otherwise disconnected. Moreover, the overall size of the connector as compared with some conventional covers is smaller and more compact thereby providing more space between connectors in an enclosure and reducing the profile.

In any event, the utilization of the extended set screw for a plug or core pin to form the vestibule accommodating the set screw results in significant economies in both labor and inventory, and an overall improved connector.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

What is claimed is:

1. An electrical connector having a metal body, conductor receiving passages in said body, respective intersecting threaded holes for each conductor receiving passage, a set screw in each threaded hole, and an insulating covering for said connector, said covering including individual respective vestibules for each set screw, each vestibule being internally threaded with threads matching that of the set screw.

2. A connector as set forth in claim 1 wherein each set screw includes a recessed head for driving the screw, and a hole in the outer end of each set screw vestibule corresponding to the recessed head.

3. A connector as set forth in claim 1 wherein each vestibule is restricted at its outer end to capture the set screw as it is backed out of its respective threaded hole.

4. An electrical connector having a metal body, conductor receiving passages in said body, respective intersecting threaded holes for each conductor receiving passage, a set screw in each passage, and an insulating covering for said connector, said covering including individual respective vestibules for each set screw, each vestibule being restricted at its outer end to capture the set screw as it is backed out of its respective threaded hole.

5. A connector as set forth in claim 4 wherein each vestibule is internally threaded.

6. A connector as set forth in claim 4 wherein each set screw includes a recessed head for driving the screw, and a hole in the outer end of each set screw vestibule corresponding to the recess.

7. A connector as set forth in claim 4 wherein each set screw is provided with a recessed hexagonal drive head, and a corresponding hole in the outer end of each vestibule to receive a turning tool for the recessed drive head.

8. A connector as set forth in claim 4 wherein each vestibule is internally threaded with threads matching that of the respective set screws.

* * * * *